US005864909A

United States Patent [19]

Liu

[11] Patent Number: 5,864,909

[45] Date of Patent: Feb. 2, 1999

[54] COMBINATION CUTTER AND STENCIL AND METHOD OF USING SAME

[76] Inventor: Pamela Liu, 253 Pleasant St., Arlington, Mass. 02174

[21] Appl. No.: 904,799

[22] Filed: Aug. 1, 1997

[51] Int. Cl.[6] ..... B25F 1/00

[52] U.S. Cl. ..... 7/113; 30/315

[58] Field of Search ..... 7/110, 113; 30/315, 30/316; D7/672; 99/430; D19/40

[56] References Cited

U.S. PATENT DOCUMENTS

| | | | |
|---|---|---|---|
| 102,225 | 4/1870 | Cooke | 7/113 |
| 3,984,033 | 10/1976 | Groth et al. | 222/333 |
| 3,991,897 | 11/1976 | Meyers | 215/230 |
| 4,114,781 | 9/1978 | Doyel | 222/326 |
| 4,424,601 | 1/1984 | Weber | 7/113 |
| 4,801,014 | 1/1989 | Meadows | 206/423 |
| 5,359,928 | 11/1994 | Blessington et al. | 101/128.4 |

OTHER PUBLICATIONS

"Fast & Friendly Stenciling", American Traditional Stencils Brochure HOTP 2006.

"Cookie Cutters and Cookie Molds", P.S. Wetherill, 1985, pp. 17, 66, 114 and 122.

"10 Techniques for Cake Stencilling", A. Albers.

*Primary Examiner*—Eileen P. Morgan
*Assistant Examiner*—Joni B. Danganan
*Attorney, Agent, or Firm*—Brian M. Dingman

[57] ABSTRACT

A combination cutter and stencil device. The device includes a cutter having a cutting peripheral edge, and a gripping portion, and a stencil plate with openings arranged in a design. The stencil plate is permanently or temporarily fixed to the cutter. Once material is cut to shape with the cutting peripheral edge, the stencil plate is placed on the cut shape, to allow the design to be created by application of stencil material through the stencil plate openings. Also disclosed are methods of cutting and stenciling using such a device.

19 Claims, 6 Drawing Sheets

COMBINATION CUTTER AND STENCIL AND METHOD OF USING SAME

FIELD OF INVENTION

This invention relates to a combination cutter and stencil device, and the use of such a device to create shaped and decorated objects such as cookies.

BACKGROUND OF THE INVENTION

There are numerous situations in which a relatively soft, planar material needs to be cut into a particular shape, and then decorated with paint or a similar material, to create on the cut shape a design. Examples include foodstuffs such as cookies, biscuits, canapes, and tea sandwiches, as well as items such as ceramic tiles and ornaments. Because cookies are the most common example of such, much of the following description will be directed to cookie cutting and decoration, although this should not be taken as a limitation to the scope of the invention.

To make decorated cookies, it is necessary to first cut the cookie from cookie dough using a cookie cutter, and then decorate the cookie using frosting, sprinkles, candy, or edible paint, for example. Frosting and painting require artistic ability and a steady hand for good results.

It is possible to more carefully decorate a cookie using a cookie stencil, which is a flat plate with a number of openings arranged to create a design. The plate is placed on the cookie, and frosting or paint is applied through the openings onto the cookie. When the stenciling is done, the stencil is lifted off of the cookie, and the cookie is baked.

However, since the stencil is not a part of the cookie cutter, the baker needs to keep separate sets of cookie cutters and stencils, which uses valuable kitchen shelf space, and requires additional organization. Also, in use the stencils must be carefully lifted from the cookie after the design is complete so as not to smear the design, or damage the fragile cookie dough. The flat stencil plates are fairly difficult to carefully grip and remove in this manner. Thus, stencil plates are relatively difficult to use and may not result in a high quality, pleasingly decorated cookie.

The shape of such stencil plates, and of the design carried by the plate, bears no relationship to the shape of the cookie. This can result in less than all of the design fitting on an already-cut cookie, or require the cookie to be overly large in order to carry the whole design. Also, because the cutters and stencils are separate, the stencil design cannot be integrated with the cookie shape.

Stencilling is also distinguished from embossing. Embossing requires a structure which interacts with and shapes the material. Thus, the embossing surface cannot be flat. In contrast, stencilling contemplates openings in a plate which sits very near (and preferably directly on) the material, but which do not themselves have any effect on the material.

SUMMARY OF THE INVENTION

It is therefore an object of this invention to provide a combination cutter and stencil device.

It is a further object of this invention to provide such a device which is more likely to result in a good quality stenciled object.

It is a further object of this invention to provide such a device that is a quicker and easier means of accomplishing decorated objects.

It is a further object of this invention to provide such a device which takes less shelf space and less organization than existing devices.

It is a further object of this invention to provide such a device that allows for easy and correct alignment of cutter and stencil.

This invention features a combination cutter stencil device for cutting and allowing stenciled decoration of a generally planar, relatively soft, material, comprising a cutter having a cutting peripheral edge, and a gripping portion, and a stencil plate with openings arranged in a design, either permanently or removably fixed to the cutter, for placement on or proximate the cut material, to allow the design to be created on the cut material by application of stencil material through the stencil plate openings.

The stencil plate may be integral with the cutter, or removably fixed to the cutter. The stencil plate may be fixed to the gripping portion of the cutter, and may be integral with the gripping portion. This may be accomplished by providing the stencil openings on the flat backside of a cutter having a depth greater than the thickness of the material to be cut. In such case, the device may be used by first cutting the material by pushing the cutting peripheral edge of the cutter through the material, and, while holding the gripping portion, removing the device from the material, flipping the device over, placing the stencil plate down on the surface of the cut shape with the cutting peripheral edge facing up, and applying the decorative material to the cut shape through the openings in the stencil plate. The stencil plate may include raised ridges outlining at least some of the openings on the side of the stencil plate that is placed on the cut shape during the stenciling portion of the operation. These ridges can seal the openings against the material when the stencil is placed on the material, so that the stencil material will not bleed outside of the periphery of the openings. Ridges can also be placed elsewhere, so that stenciling and imprinting of a design are accomplished simultaneously.

The stencil plate may be removably fixed to the cutter. This may be accomplished by arranging the stencil plate to tightly fit over the cutting edge of the cutter. This allows asymmetrical cookies to be stenciled without first turning them over after cutting. An alternative arrangement contemplates removably holding the stencil plate on the gripping portion of the cookie cutter, for example by providing screw threads on the gripping portion and mating screw threads on the stencil plate, or by including a third piece such as a threaded, open cap in which the stencil plate sits, which can itself be threaded onto the threads of the cutter. This threaded, open cap may include some means for tightly holding the stencil plate therein, spanning the opening in the cap. If this means is provided, the cap would not need to be threadably-received on the cookie cutter, but could be adapted to tightly fit over the cookie cutter, thus holding the stencil plate relative to the cutting edge.

Also featured are methods of cutting a defined shape from a generally planar, relatively soft, material, and stencilling a design on the cut material with stencil material, comprising providing a cutter having a cutting peripheral edge defining a shape, and a gripping portion; pressing the cutting edge into the material to cut a defined shape from the material; providing a stencil plate with openings arranged in a design, permanently or removably fixed to the cutter; applying the stencil material to the cut material through the openings in the stencil plate to create the stencil plate design on the cut material.

The method may further include the step of removing the cutter from the material by lifting the gripping portion, and then placing the stencil plate on the cut material, before applying the stencil material. The stencil plate may be removably fixed to the cutter after the cutter is removed from the material, and may be removably fixed proximate the cutting peripheral edge of the cutter. Alternatively, the stencil plate may be removably fixed to the gripping portion of the cutter.

Alternatively, a one step cut-and-stencil arrangement may be accomplished if the cutter is the same depth as the planar material to be cut. The device may be used by first cutting the material and while the stencil plate is lying against the surface of the moldable material, and applying a decorative material through the openings in the stencil plate to the surface of the moldable material. For these arrangements the stencil plate may include raised ridges outlining one side of the stencil plate that is placed on the cookie during the stenciling portion of the operation.

BRIEF DESCRIPTION OF THE DRAWINGS

Other objects, features and advantages will occur to those skilled in the art from the following description of the preferred embodiment, and the accompanying drawings, in which.

DESCRIPTION OF THE PREFERRED EMBODIMENTS

Figure 1B:
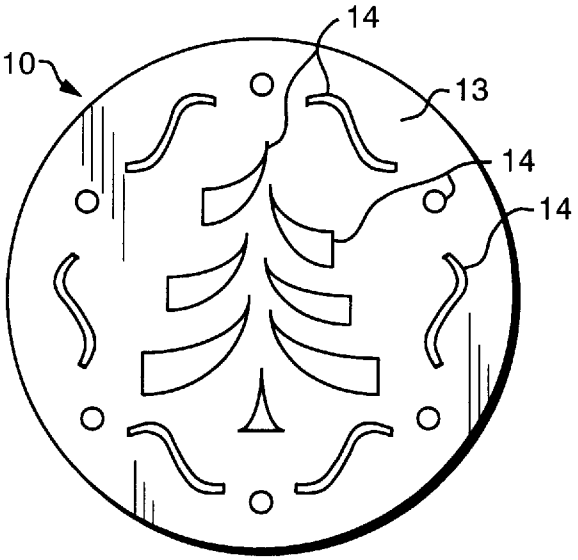
FIGS. 1A through 1C are bottom, top, and cross-sectional views, respectively, of an embodiment of an integral cutter and stencil device according to this invention.
Figure 1A:
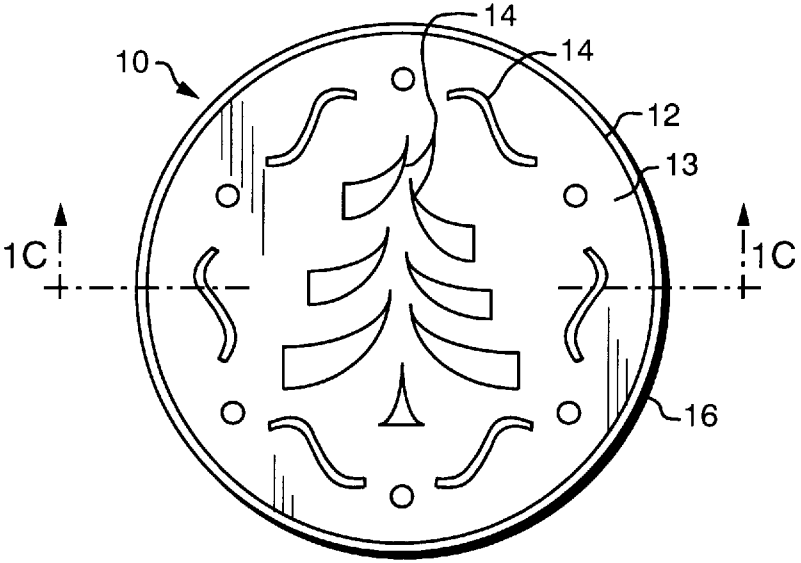
Figure 1C:
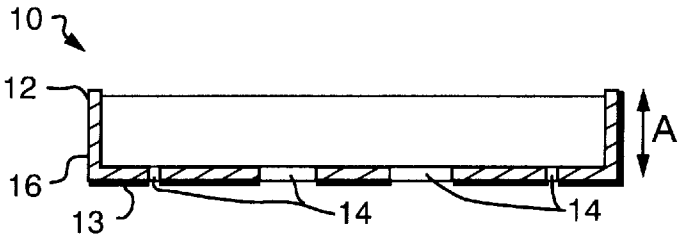

There is shown in FIGS. 1A through 1C an embodiment of a combination cutter and stencil device according to this invention. The preferred embodiments herein are shown and described as a cookie cutter and stencil, although this should not be taken as a limitation of the invention, as the invention is applicable to any generally planar, relatively soft, moldable material, including foodstuffs and other materials which can be cut to shape and stenciled. The embodiment of FIGS. 1A through 1C includes cookie cutter 10 having a cutting peripheral edge 12 and gripping portion 16. Stencil plate 13 is integral with cutter 10, in this embodiment comprising the top flat surface 13 of cookie cutter 10. There is no handle on surface 13, which would interfere with its use as a stencil. Stencil plate 13 includes a plurality of openings 14 arranged in a design, in this case a Christmas tree surrounded by decorative portions. A design can be created on a cookie by placement of stencil plate 13 onto or very close to a cookie, and the application of cookie stencil material (such as edible paint or frosting) to the cookie through openings 14.

Figure 2:
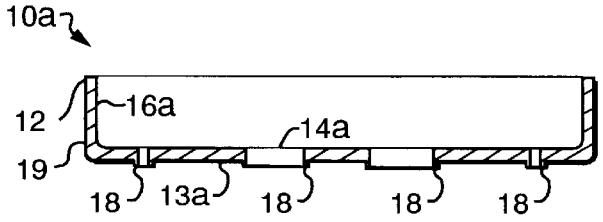
FIG. 2 is a cross-sectional view of an alternative arrangement of the device of FIG. 1.

To prevent bleeding of the stencil material from the openings, it may be desirable to include raised ridges 18, FIG. 2, outlining at least some of openings 14*a* on at least one side of stencil plate 13*a*. FIG. 2 also shows the preferred rounded edges 19 at the location where gripping portion 16*a* meets stencil plate 13*a*. These rounded edges are less likely to damage the cookie.

FIGS. 3 through 9 detail alternative preferred embodiments in which the stencil plate is removably fixed to the cutter. This can be accomplished in any convenient manner, including but not limited to the ones shown in the drawings. In these embodiments, the device may be configured so that the stencil can be fit over the cutting edge. This allows asymmetrical cookies to be stenciled without the need to flip the cookie over after it is cut. Also, the removable stencil allows the provision of multiple different stencil designs that can be used in conjunction with a single cookie cutter.

Figure 3:
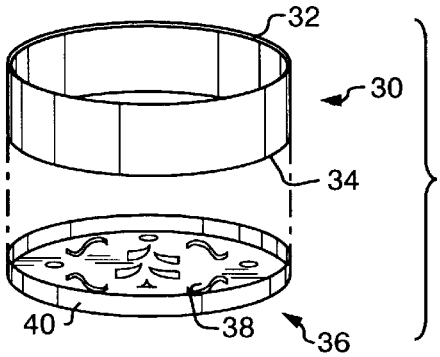
FIG. 3 is a side disassembled view of an alternative device according to this invention with a removable stencil plate.

Combination cookie cutter/cookie stencil device 30, FIG. 3, includes cookie cutter 32 having cutting edge 34. Stencil 36 includes flat stencil plate 38 with openings therethrough, and peripheral, upwardly extending flange portion 40 that is sized and shaped to fit relatively tightly over cutting edge 34, so that stencil 36 can be pushed onto cutter 32 after the cookie has been cut. The stencil would then be placed directly on the cookie, and the stencil material would be applied through the openings in the stencil plate.

Figure 4A:
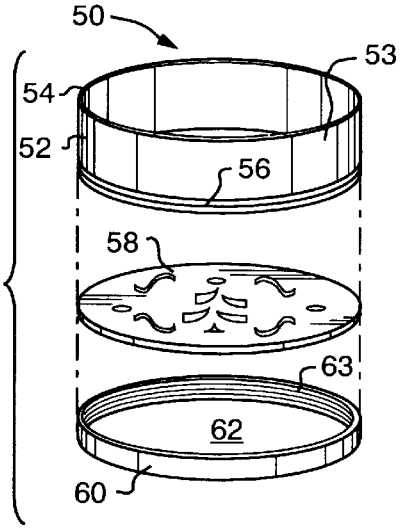
FIGS. 4A and 4B are disassembled side and cross-sectional views, respectively, of an alternative to the device of FIG. 3.
Figure 4B:
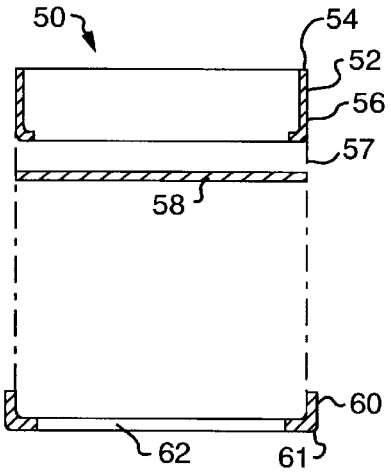

For symmetrical cutters, the stencil plate could alternatively be removably fixed to the gripping portion of the cookie cutter. An embodiment of such an arrangement is shown in FIGS. 4A and 4B. Device 50 according to this invention includes cookie cutter 52 having peripheral cutting edge 54, and threads 56 on the outside of gripping portion 53. Stencil plate 58 is a flat plate having about the same diameter as cutter 52, and is removably fixed to the cutter gripping portion 53 through cap 60 that has opening 62 and internal threads 63 that mate with threads 56. For non-circular symmetric shapes, the cap 60 would fit on cutter 52 in a manner, such as friction fit, which does not use threads.

Figure 5:
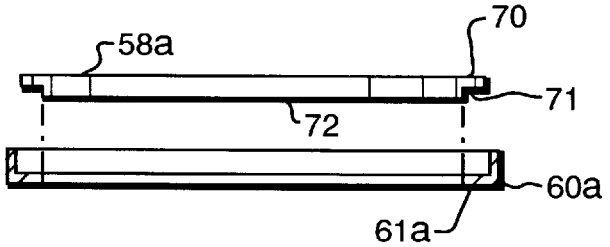
FIG. 5 is a cross-sectional disassembled view of another manner of removably fixing the stencil plate to the cutter for this invention to create a flush surface.

To create a flush stenciling surface with an arrangement such as that shown in FIG. 4, stencil plate 58*a*, FIG. 5, may have an extending inner flange portion 70 that creates shoulder 71 that sits on peripheral portion 61*a* of cap 60*a*.

Figure 6:
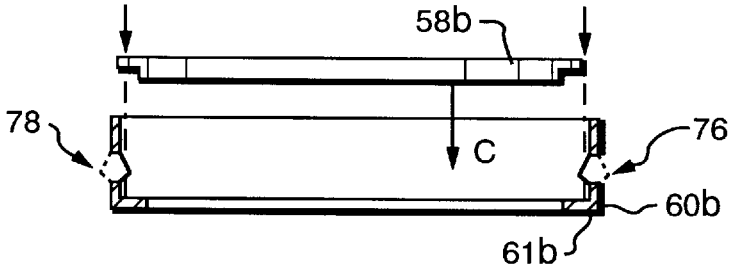
FIG. 6 is another alternative manner of removably fixing the stencil plate to the cutter of this invention.

It may be desirable to more firmly hold the stencil plate in the threaded cap by including cooperating gripping means on the stencil plate and the cap to tightly hold the stencil plate in the cap, spanning the opening in the cap. This type of arrangement is shown in FIG. 6, in which cap 60*b* has inwardly extending spring fingers 76 that are pushed outward toward the perimeter of cap 60*b* as plate 58*b* is pushed downward in the direction of arrow C. Fingers 76 are arranged so that they create a sufficient space to hold stencil plate 58*b* between fingers 76 and bottom portion 61*b* of cap 60*b*. Such an arrangement could also be used to hold a stencil plate in an open-top cutter instead of cap 60*b*, resulting in a device similar to that shown in FIG. 1.

Figure 7:
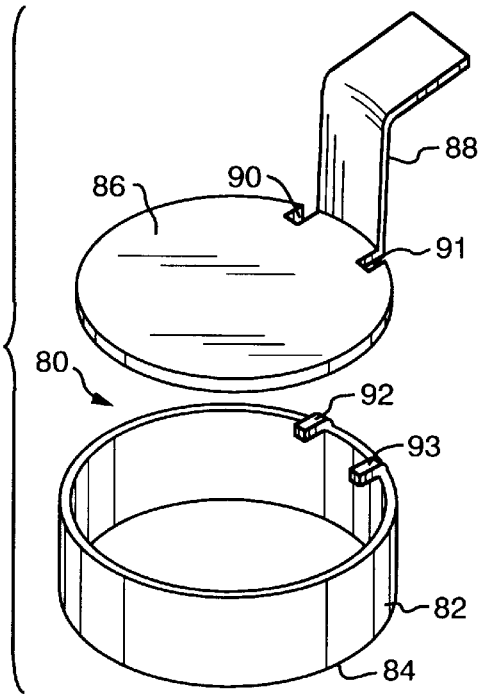
FIG. 7 is a disassembled view of yet another alternative manner of removably fixing the stencil plate to the cutter of this invention.
Figure 8:
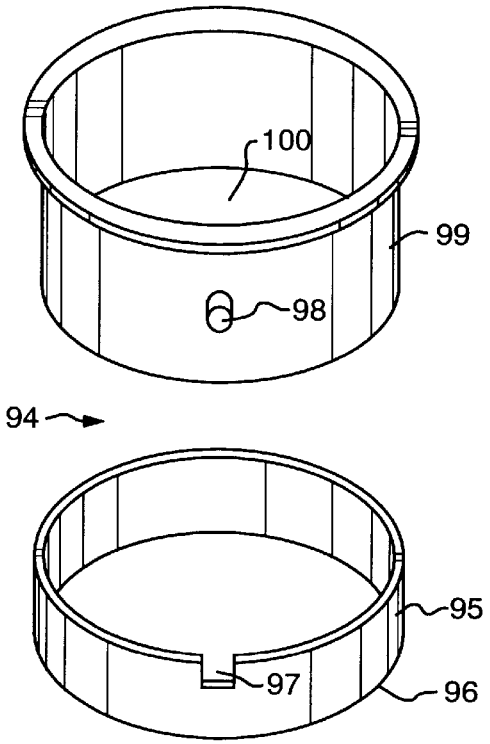
FIG. 8 is a disassembled view of still another alternative manner of removably fixing the stencil plate to the cutter of this invention.
Figure 9A:
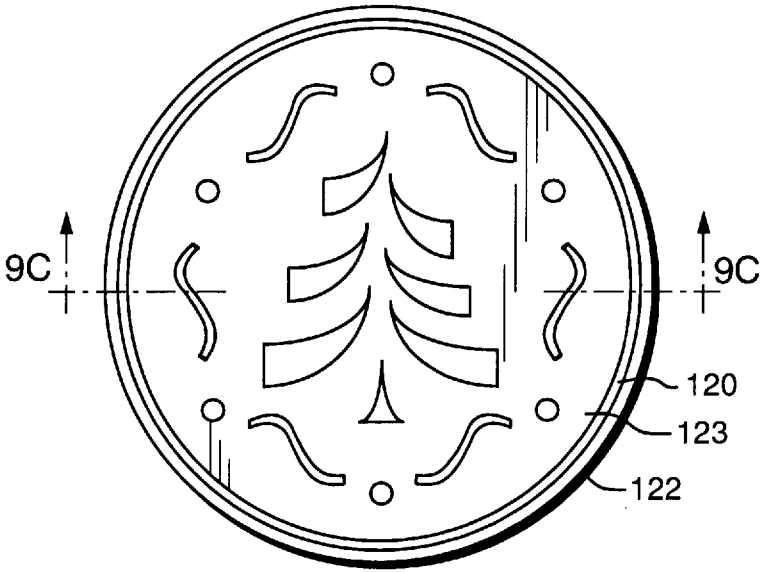
FIGS. 9A through 9C are top, side and cross-sectional views, respectively, of yet another manner of removably fixing the stencil plate to the cutter of this invention.
Figure 9C:
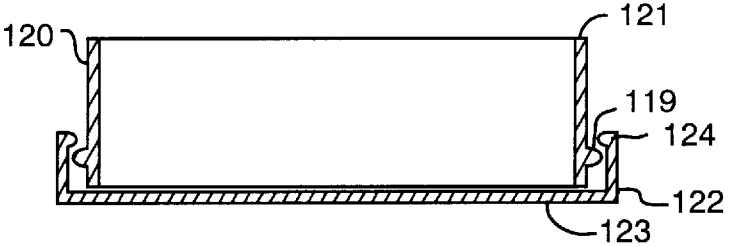
Figure 9B:
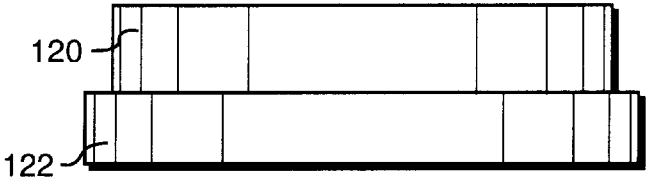

FIGS. 7 through 9 detail three embodiments of a two-piece cutter/stencil device according to this invention. For round cutters, the inclusion of means for maintaining a spatial relationship between the cutter and the stencil would prevent relative twisting movement of the cutter and stencil that could smear the stenciled pattern. For other cutter shapes, this feature is not required, because the cutter and stencil would be self aligning. In FIG. 7, stencil plate 86 has handle 88 attached thereto that allows it to be easily removed from the interior of cutter 82 having cutting edge 84. Openings 90 and 91 fit over protruding guides 92 and 93 to prevent relative rotation.

In FIG. 8, cutter 95 having cutting edge 96 includes slot 97 into which protrusion 98 protruding from stencil-holding cylinder 99 fits. Stencil plate 100 is the bottom of cylinder 99. In FIG. 9, cutter 120 with cutting edge 121 has lip 119 over which fits lip 124 of cap 122 carrying stencil plate 123. Any other manner of removably fixing a stencil plate to the cutting edge and/or the top side of a cutter, are contemplated in this invention.

Figure 10A:
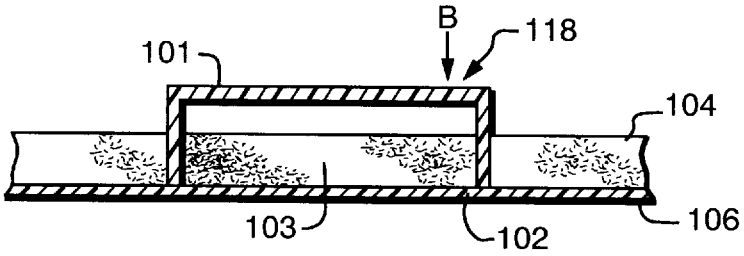
FIGS. 10A and 10B are cross-sectional views of a preferred manner of using the combination cutter and stencil device of this invention to cut and decorate a cookie.
Figure 10B:
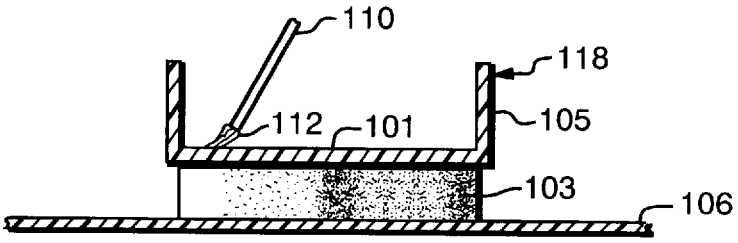

FIGS. 10A and 10B illustrate one method of cutting and stenciling a cookie according to this invention, using the device of this invention. FIG. 10A depicts combination cookie cutter/cookie stencil device 118 according to this invention, with cutting edge 102 and integral stencil plate 101, being pushed in the direction of arrow B through cookie dough 104 that has been rolled on surface 106. When the cookie 103 is cut, device 118 is lifted out of dough 104 and flipped over so that the flat back side of stencil plate 101 (the side farthest from cutting edge 102) is contacting the top of cookie 103. Paint brush 110 with brush portion 112 that has been dipped in stencil material is then used to apply the stencil material through the openings in stencil plate 101 onto the cookie. When the stenciling is complete, gripping portion 105 of device 118 is gripped to allow the stencil to be easily removed from the cookie without disturbing the cookie or the stencil material. This method is also appropriate in cases in which the stencil is removably attached to the top of the cutter, instead of integral therewith as shown in this drawing.

There are two other methods of using the devices of this invention. Stencil material could be applied through stencil plate 101 while it was over the cut cookie in the position shown in FIG. 10A. For accurate stenciling, this would require the dough thickness to be such that the dough touched, or almost touched, the underside of plate 101.

The third method is similar to that shown in FIG. 10B, except with the stencil plate removably attached to the cutting edge 102, as shown above in FIG. 3. In this case, the device 118 would not be flipped over, but rather the stencil plate would be attached to the cutting edge, and then placed down on the cut form.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A combination cutter stencil device for cutting and allowing stenciled decoration of a generally planar, relatively soft material, comprising:

a cutter having a cutting peripheral edge, and a gripping portion; and a stencil plate with openings arranged in a design, operably attached to the cutter, for placement on or proximate the cut material, to allow the design to be created on the cut material by application of stencil material through the stencil plate openings.

2. The stencil device of claim 1 in which the stencil plate is integral with the cutter.

3. The stencil device of claim 1 in which the stencil plate is fixed to the gripping portion.

4. The stencil device of claim 1 in which the stencil plate includes raised ridges outlining at least some of the openings on at least one side of the stencil plate, to seal the openings against the cut material when the stencil plate is placed on or proximate the cut material.

5. The stencil device of claim 1 in which the stencil plate is removably fixed to the cutter.

6. The stencil device of claim 5 in which the stencil plate fits tightly over the cutting edge so that an asymmetrical cut material can be stenciled without first turning the material over after cutting.

7. The stencil device of claim 5 in which the stencil plate is held onto the gripping portion.

8. The stencil device of claim 5 including cooperating means on the cutter and the stencil plate for removably fixing the stencil plate to the cutter, to prevent relative rotation of the cutter and stencil plate.

9. The stencil device of claim 8 in which the cooperating means include one or more protrusions on the cutter or stencil plate, and one or more mating protrusion-receiving openings on the other of the cutter and stencil plate.

10. The stencil device of claim 5 in which the cutter has a substantially open top, and further including a cooperating gripping means on the stencil plate and cutter to tightly hold the stencil plate in the cutter, spanning the opening.

11. The stencil device of claim 1 in which the stencil plate is held onto the cutter by providing screw threads on the cutter, and mating screw threads on a stencil plate fixing portion.

12. The stencil device of claim 11 in which the stencil plate fixing portion includes a threaded, open cap in which the stencil plate sits.

13. The stencil device of claim 12 further including cooperating gripping means on the stencil plate and cap to tightly hold the stencil plate in the cap, spanning the opening.

14. The stencil device of claim 1 in which the stencil includes a rounded peripheral edge to inhibit marring of the material by the stencil plate.

15. A method of cutting a defined shape from a generally planar, relatively soft, material, and stencilling a design on the cut material with stencil material, comprising:

a. providing a cutter having a cutting peripheral edge defining a shape, and a gripping portion;

b. pressing the cutting edge into the material to cut a defined shape from the material;

c. providing proximate the cut shape a stencil plate with openings arranged in a design, operably attached to the cutter; and d. applying the stencil material to the cut defined shape of material through the openings in the stencil plate to create the stencil plate design on the cut material.

16. The method of claim 15 further including, before applying the stencil material, and after pressing the cutting edge into the material, the step of removing the cutter from the material by lifting the gripping portion, and then placing the stencil plate on the cut material.

17. The method of claim 16 further including the step of fixing the stencil plate to the cutter, whereby the stencil plate is removably fixed to the cutters, after the cutter is removed from the material.

18. The method of claim 17, in which the stencil plate is removably fixed, via said fixing step, proximate the cutting peripheral edge of the cutter.

19. The method of claim 17, in which the stencil plate is removably fixed, via said fixing step, to the gripping portion of the cutter.

* * * * *